United States Patent [19]

Reba

[11] 4,422,565

[45] Dec. 27, 1983

[54] STRIP MATERIAL TRANSPORTING APPARATUS

[75] Inventor: Imants Reba, Vancouver, Wash.

[73] Assignee: Crown Zellerbach Corporation, San Francisco, Calif.

[21] Appl. No.: 328,355

[22] Filed: Dec. 7, 1981

[51] Int. Cl.[3] ..... B65H 17/32

[52] U.S. Cl. ..... 226/97; 226/7; 406/153

[58] Field of Search ..... 226/95, 97, 7; 406/94–95, 93, 151–153, 194, 195; 137/604

[56] References Cited

U.S. PATENT DOCUMENTS

| | | | |
|---|---|---|---|
| 3,822,918 | 7/1974 | Jungers | 406/194 |
| 3,999,696 | 12/1976 | Reba et al. | 226/7 |
| 4,181,247 | 1/1980 | McFall | 226/97 |
| 4,186,772 | 2/1980 | Handleman | 137/604 |
| 4,206,555 | 6/1980 | Musto | 406/153 |
| 4,215,956 | 8/1980 | Reba | 406/152 |
| 4,265,573 | 5/1981 | Reba | 406/152 |

FOREIGN PATENT DOCUMENTS

| | | | |
|---|---|---|---|
| 56-155120 | 12/1981 | Japan | 406/151 |

*Primary Examiner*—Leonard D. Christian
*Attorney, Agent, or Firm*—Thomas R. Lampe

[57] ABSTRACT

Apparatus for transporting strip material from a first location to a second location including a first conduit, a venturi device disposed along the first conduit and means for generating fluid flow in the interior of the first conduit through the venturi device. A second conduit leads from the first location to the venturi device and an auxiliary fluid flow generating means is provided for entraining the strip material at the first location and transporting it through the second conduit to the venturi device.

9 Claims, 3 Drawing Figures

STRIP MATERIAL TRANSPORTING APPARATUS

BACKGROUND OF THE INVENTION

1. Field of Invention

This invention relates to apparatus for transporting strip material such as paper or plastic film trim from a first location to a second location.

2. Description of the Prior Art

During paper and plastic film manufacture trim is often cut from an edge or edges of the web material during manufacture or conversion.

There are essentially two basic conventional trim handling systems, namely the continuous ribbon system and the chopped trim system. In the continuous ribbon system air from a fan or blower enters a venturi-type ejector where, due to flow acceleration, sub-ambient pressure is generated. A vertical duct or downspout connects this low pressure region with a trim receptacle mounted near the trim slitter mechanism. The venturi and the fan are sized to provide sufficient pressure differential so that the velocity of the entrained downspout flow exceeds the trim speed by at least 500 fpm and preferably by at least 1000 fpm. In order to provide sufficient entrainment the fan static pressure must be approximately 4½ times greater than the duct pressure loss. Since the duct pressure loss increases with both the air velocity and the duct length, high speed conveying of continuous trim ribbon over long distances becomes difficult if not impractical. The main problems are: expensive blowers, high energy consumption, and excessive noise produced by the venturi ejector.

Problems also exist relative to the chopped trim system wherein the downspout is connected directly to the fan inlet. As the trim ribbon passes through a specially designed fan blade it is cut into small pieces which are then conveyed into the fan exhaust. Although such a trim handling system operates at low horsepower and is somewhat less noisy than the continuous ribbon system, the trim handling at the exit requires either a large efficient cyclone or a baler, arrangements that are both labor and capital intensive and require large working spaces.

BRIEF SUMMARY OF THE INVENTION

In the conventional prior art systems described above both the trim pickup and transport functions are accomplished by the action of a single flow generation means. Therefore, an excessive amount of air must be introduced to provide trim pickup.

In the apparatus of the present invention, on the other hand, two separate and separately controllable fluid flow sources are utilized, one at the trim pickup location and the other in operative association with the main trasport duct. As is the case with some prior art arrangements a venturi device is disposed along the trim transport duct, however, in contrast to conventional systems, the venturi device of the present invention is not operated as an ejector wherein the sub-ambient pressure at the venturi throat produces air flow in the downspout. In the present arrangement an auxiliary conduit leads from the trim pickup point to the main duct or conduit in the vicinity of the venturi device disposed in the main duct. The pickup conduit incorporates one or more Coanda nozzles that produce the required entrainment and downspout velocity. From the pick-up conduit the trim is introduced into the venturi throat under essentially ambient pressure conditions. The trim will be picked up regardless of the pressure at the venturi throat which means of course that the primary fluid flow generating means operatively associated with the primary duct need not generate high velocities in the venturi throat nor does it require a high power consumption to operate. In addition, since flow velocities in the venturi throat are greatly reduced as compared to prior art arrangements, the noise level will be lowered.

DETAILED DESCRIPTION

Figure 1:
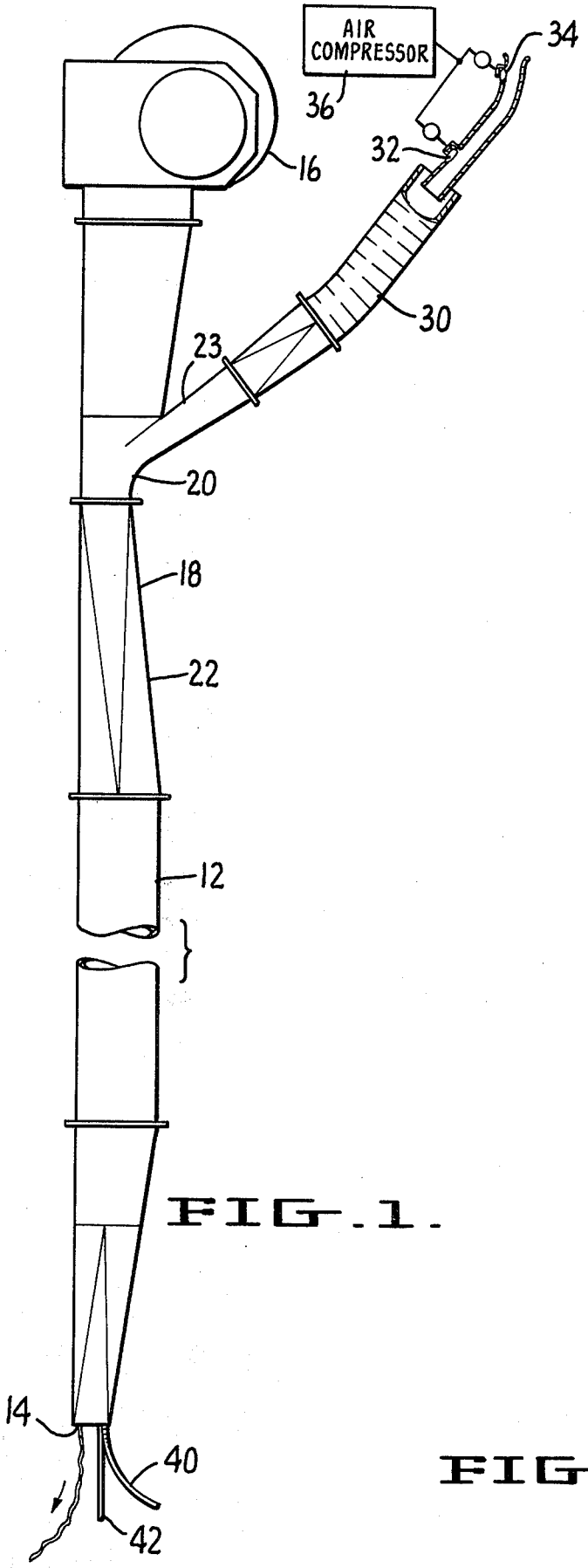
FIG. 1 is a side elevational view of apparatus constructed in accordance with the teachings of the present invention.
Figure 2:
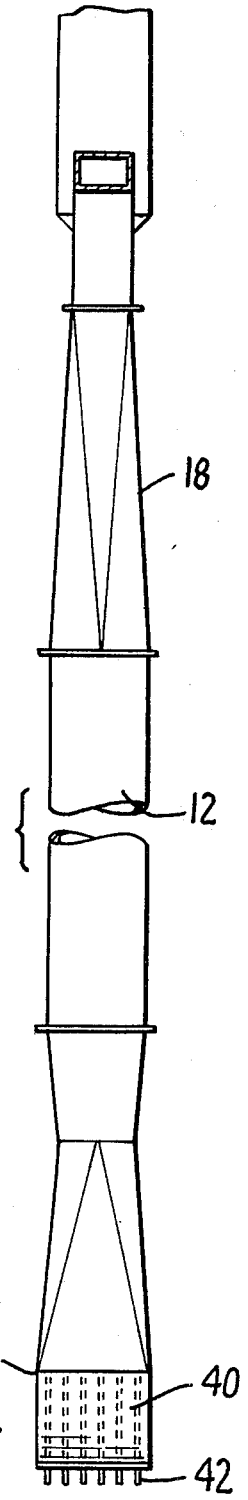
FIG. 2 is a front elevational view of the apparatus.

Referring now to FIGS. 1 and 2, apparatus constructed in accordance with the present invention includes a first conduit 12 having a downstream end 14. The first conduit defines an interior leading to the downstream end from a blower fan 16 of any suitable conventional type. Disposed along first conduit 12 is asymmetric venturi device 18 which includes a restricted venturi throat 20 and a venturi diffuser 22.

A second conduit 30 is joined to first conduit 12 and the second conduit includes a downstream end 23 positioned at venturi throat 20. The upstream end of the second conduit leads from a slitter (not shown) or other source of trim to be conveyed by the apparatus. At its downstream end the interior of second conduit 30 communicates with the interior of venturi throat 20. At the upstream end a portion of the second conduit 30 may be of reduced diameter as shown, but in any event, has disposed therein Coanda nozzles 32, 34, said nozzles being of the type shown, for example, in U.S. Pat. No. 3,999,696, Reba et al., issued Dec. 28, 1976. The Coanda nozzles are connected by a suitable air supply line to an air compressor 36. Control of air from the air compressor to the Coanda nozzles is accomplished through suitable valves disposed in the air supply line. Upon communication being established between the air compressor and the Coanda nozzles the nozzles will result in a flow of air within second conduit 30 toward venturi device 18. The air flow will be the combined flows of pressurized air from the nozzles and ambient air entrained thereby. Such air flow causes the trim to be picked up at the upstream end of second conduit 30 and delivered therein to the venturi device.

At the same time, air flow is generated within first conduit 12 by actuation of fan 16 so that the air flow passing downstream from the venturi device is the combined air flow as generated by the Coanda nozzles and the fan. Preferably, the flow velocity downstream from the venturi device is in the order of 1000 fpm faster than the speed of the trim being removed from the slitter or other trim source. From an operational standpoint the design of the venturi device is not critical; that is, the trim will be picked up and conveyed whether or not the pressure at the venturi throat is below, at or above ambient. A sliding adjustment plate or valve (not shown) may be employed to adjust flow from the fan.

With increasingly higher trim conveying speeds the handling of air at the downstream end of first conduit 12 poses problems. If screen baskets and cyclones are employed they require considerable space and are prone to plugging. If discharge is accomplished directly from the open end the trim will blow over the surrounding area. In the arrangement of the present invention a greater degree of control is accomplished by changing the direction of the air as it exits from the first conduit end separating it from the trim. Specifically, a plate 40 defining a curved Coanda surface is attached to the downstream end of conduit 12 to direct the air flow laterally (toward the right as viewed in FIG. 1). This is accomplished due to attachment of the air to the plate by virtue of the Coanda effect. A grill 42 prevents the trim ribbon from being diverted with the air. Exposed to the stationary ambient air, the trim ribbon loses its momentum and gravity directs it towards a beater or other collector (not shown).

Figure 3:
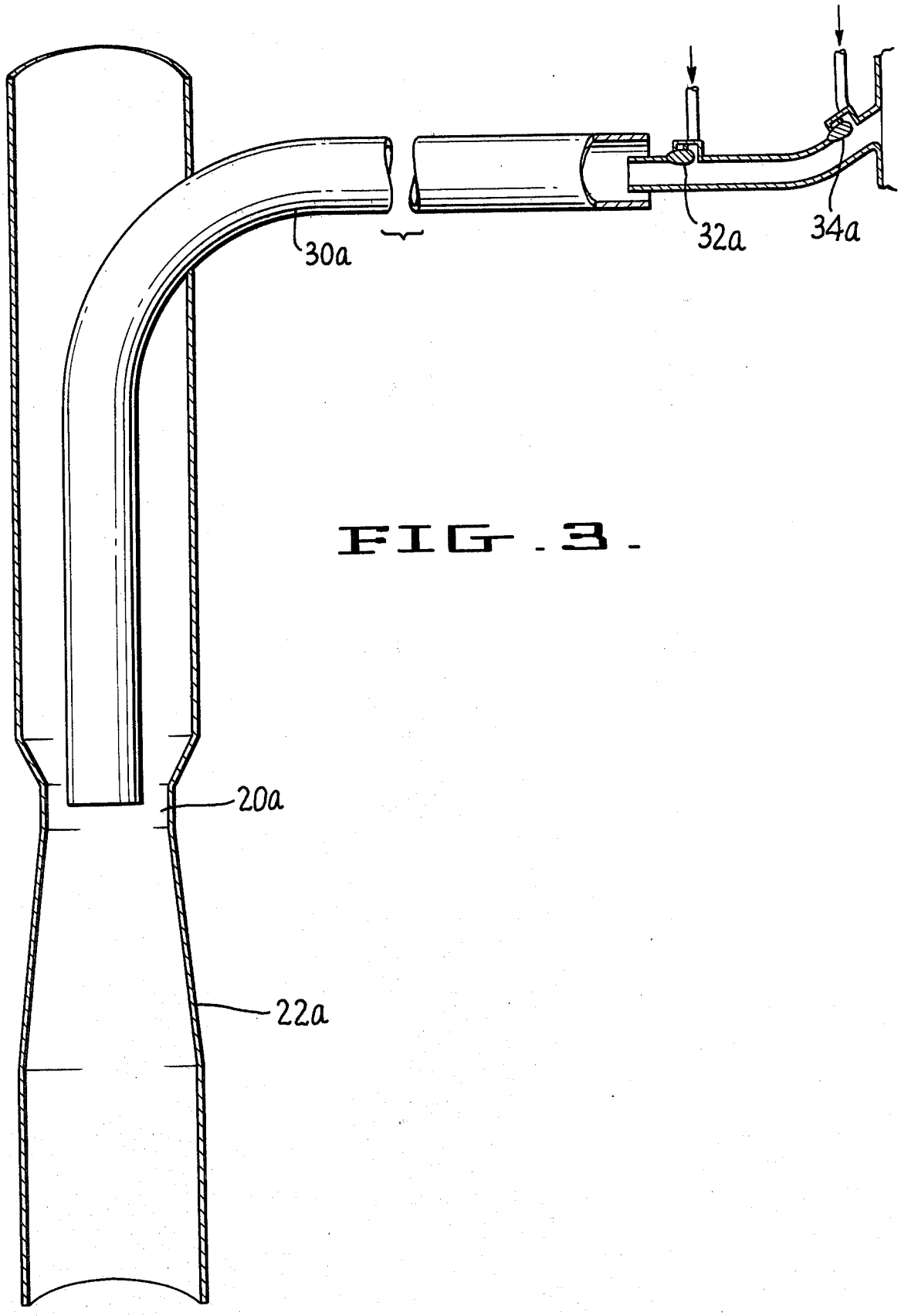
FIG. 3 is an enlarged cross sectional view showing operational details of selected portions of an alternative form of apparatus.

Referring now to FIG. 3, details of selected portions of an alternative form of apparatus are illustrated. In this embodiment, venturi device is symmetrical with the throat 20*a* being a regular cylinder and diffuser 22*a* having the general shape of a truncated cone. Second conduit 30*a* is smaller than throat 20*a* and is substantially concentrically disposed therein. At the upstream end a portion of second conduit 30*a* may be of reduced diameter as shown, but in any event, has disposed therein Coanda nozzle 32*a* and 34*a*.

I claim:

1. Apparatus for transporting strip materials from a first location to a second location comprising, in combination:

a first conduit defining an interior leading to said second location;

a venturi device including a venturi throat and venturi diffuser disposed along said first conduit and in communication with the interior thereof;

means for generating fluid flow in said first conduit interior and through said venturi throat and diffuser;

a second conduit leading from said first location to the vicinity of said venturi throat; and auxiliary fluid flow generating means for entraining said strip material at said first location and transporting said strip material through said second conduit to said venturi throat.

2. The apparatus of claim 1 wherein said auxiliary fluid flow generating means at least one Coanda nozzle.

3. The apparatus of claim 1 wherein the downstream end of said second conduit terminates within said venturi device at said venturi throat.

4. The apparatus of claim 3 wherein said second conduit has a downstream end smaller than said venturi throat.

5. The apparatus of claim 4 wherein said second conduit downstream end is substantially concentrically disposed in said venturi throat.

6. The apparatus of claim 1 wherein said first conduit has a downstream end and wherein the apparatus additionally comprises means disposed at the downstream end of said first conduit at said second location for separating strip material from fluid flow.

7. The apparatus of claim 6 wherein said separating means comprises a curved plate having a Coanda surface for diverting fluid flow laterally at said first conduit downstream end and barrier means attached to said first conduit downstream end for preventing said strip material from moving with said diverted fluid flow.

8. Apparatus for transporting strip material from a first location to a second location comprising, in combination:

a first conduit defining an interior leading to said second location;

means for generating air flow in said first conduit toward said second location;

a venturi device disposed along said first conduit;

a second conduit leading from said first location to the interior of said first conduit at the location of said venturi device;

auxiliary fluid flow generating means for entraining strip material in a fluid flow in said second conduit and directing said strip material to said venturi device, said venturi device adapted to accelerate the combined fluid flows within said first conduit.

9. The apparatus of claim 8 wherein said auxiliary fluid flow generating means comprises at least one Coanda nozzle.

* * * * *